United States Patent [19]

Peek

[11] 4,323,743

[45] Apr. 6, 1982

[54] MEANS FOR OPERATING BLAST VALVE IN TWO-PRESSURE CIRCUIT BREAKER

[75] Inventor: Henry L. Peek, Naples, Fla.

[73] Assignee: Siemens-Allis, Inc., Atlanta, Ga.

[21] Appl. No.: 105,083

[22] Filed: Dec. 19, 1979

[51] Int. Cl.[3] ..... H01H 33/86

[52] U.S. Cl. ..... 200/148 F; 200/148 R; 200/148 D

[58] Field of Search ..... 200/148 B, 148 R, 148 F, 200/148 D

[56] References Cited

U.S. PATENT DOCUMENTS 3,033,962 5/1962 Friedrich et al. ..... 200/148 B 3,922,512 11/1975 Benham ..... 200/148 R

*Primary Examiner*—Robert S. Macon

*Attorney, Agent, or Firm*—Frederick W. Powers, III

[57] ABSTRACT

An improved limited-travel linkage for "cracking" a gas blast valve in a circuit breaker. A projection from a portion of the circuit breaker linkage travels along an arc in interfering relationship with a spring-loaded latch on a crank. Movement in one direction engages the latch, turning the crank and cracking the valve. Arc quenching gas then flows through a conduit to the interrupter contacts to blow out the arc drawn between them.

6 Claims, 5 Drawing Figures

MEANS FOR OPERATING BLAST VALVE IN TWO-PRESSURE CIRCUIT BREAKER

BACKGROUND OF THE INVENTION

The present invention relates to gas-type circuit breakers, and more specifically to an improved arrangement for operating a gas blast valve used in circuit breakers of the two-pressure type.

As transmission line voltages have attained ever higher values, the need has increased for circuit breakers of commensurately increased capacity. While in the past circuit breakers operating in air, or using vacuum contactors, have been adequate recent designs have incorporated interrupters operating in an environment of sulfur hexafluoride, or $SF_6$. In order to extinguish the arc which is typically drawn between separating contacts at extremely high voltages, means are provided to direct a high-pressure jet of $SF_6$ gas between the contacts in order to literally "blow out" the arc.

Such circuit interrupters typically are of two varieties. In one, termed a "puffer" breaker, mechanical pistons or bellows are provided to compress gas which is disposed in the interrupting chamber, causing it to flow in the desired fashion. In the other, or "two-pressure", approach the gas is compressed into a reservoir and maintained at a high pressure by a valve. Operation of the circuit breaker by means of a linkage causes the valve to be opened momentarily, whereupon the previously-pressurized gas rushes out through a passageway and is directed to the area between the separating interrupter contacts.

The timing and sequencing of the valve operation in the two-pressure type of circuit breaker is critical. Moreover, since such breakers are typically used in threes, due to their application in three-phase power systems, the elastic characteristics of the linkages and the connecting links used to synchronize them make it extremely difficult to properly time the operation of the blast valve. In addition, due to the extreme speed involved and the necessarily robust nature of the linkages, the mechanical forces which are generated are extremely high. Previously-known linkages for operating blast valve have often been difficult to adjust and to synchronize. Further, the type of valve used typically requires a short, reciprocating stroke which is accurately timed, which is difficult to accomplish with the required precision and accuracy.

It is therefore an object of the present invention to provide an improved valving mechanism for a two-pressure circuit breaker.

Another object of the present invention is to provide a linkage which will "crack" a valve by a fixed amount regardless of the length of travel of the operating mechanism.

It is yet another object of the invention to provide a fully adjustable valve actuating means for a two-pressure circuit breaker whose operation is adjustable independently of the main operating linkage of the breaker.

SUMMARY OF THE INVENTION

Briefly stated, in accordance with one aspect of the invention the foregoing objects are achieved by providing a valve means in a gas conduit, which serves to restrain high-pressure gas in a reservoir from flowing through the conduit and into the area about interrupter contacts. A linkage is coupled to the interrupter, and has a lever coupled thereto which rotates in an arc in a first direction to open the interrupter. Adjacent to the arc is a crank which is pivotally mounted, and has a latch which interferes with the travel of a portion of the lever. The other end of the crank bears a pushrod which is guided to abut the valve means.

As the interrupter is operated, the lever catches the latch and causes the crank to rotate until the lever comes out of contact with the latch. This motion is enough to open the valve means and iniate flow of the arc extinguishing gas. The crank then returns to its quiescent position. Later, as the lever returns to its quiescent position it again interferes with the latch; but due to the spring-biased mounting of the latch, the crank and latch does not prevent the lever from returning to its original position.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which;

DESCRIPTION OF A PREFERRED EMBODIMENT

Figure 1:
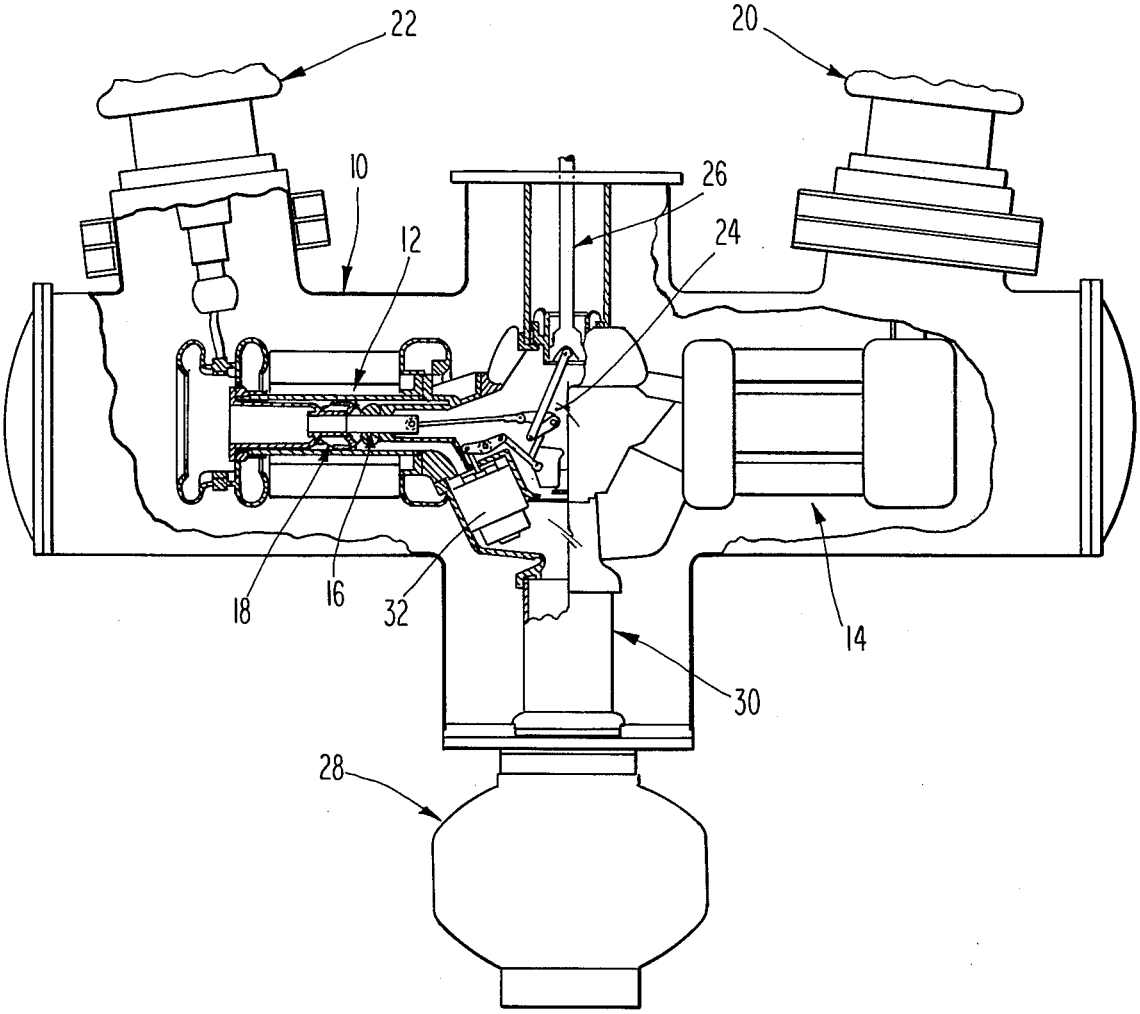
FIG. 1 represents a circuit breaker of two-pressure type.

In FIG. 1 there is shown a high voltage circuit breaker of the so-called two pressure type. A main, low pressure tank 10 is provided, in which is encased a pair of circuit interrupters generally represented at 12 and 14. As is well known by those skilled in the art, each of the interrupters includes grading capacitors, opening and/or closing resistors, corona shields and the like. As interrupters 12 and 14 are substantially identical it is only deemed necessary to show the internal details of one, it being understood that the other is virtually a mirror image and operates simultaneously therewith. The principal components of the interrupter are a pair of engaging contact members constituted by a male member 16 and a female member 18. When the two members are coupled together current flows through them, thus completing a circuit from an input terminal which runs through an insulating bushing 20, the two interrupters in series, and a second, output insulating bushing 22. The interrupters are operated through a linkage generally designated 24.

A source of outside energy (not shown) which may be electric, pneumatic or hydraulic creates a tension on pullrod 26, thereby moving the linkage and causing male member 16 to withdraw the center of the apparatus. This breaks the circuit which was made by member 16 and 18. However, due to the extremely high voltages at which the apparatus operates, an electric arc may be drawn across the interrupter contact members as they begin to separate. Accordingly, a jet of high-pressure gas is provided to literally blow the arc out. The gas, commonly sulfur hexafluoride ($SF_6$), is compressed by suitable means (not shown) and maintained in a high pressure reservoir 28. The reservoir opens into pipe 30 which is sealed by a blast valve for each interrupter. The valve for interrupter 12 is shown at 32. The valve consists essentially of a housing and a spring-loaded plate; when the plate is depressed the valve is opened and the pressurized gas flows through the valve and thence through passages adjacent to the interrupter to the juncture of interrupter elements 16 and 18.

It will be apparent that the timing of the blast of gas is critical, as is the synchronization of circuit breakers. Typically, three circuit breakers are used in parallel to interrupt a three-phase power transmission line, one for each phase. Owing to the physical size of the elements involved it is necessary that large, rugged linkage members be provided. At the same time, it is also necessary that the mechanism act with extreme rapidity so as to interrupt the electric circuit within two cycles, or approximately a thirtieth of a second. The conflicting requirements for the operating linkage has made it extremely difficult to design an economical means for operating the interrupter, including the blast valve, which is at once simple, adjustable, and dependable.

Figure 2:
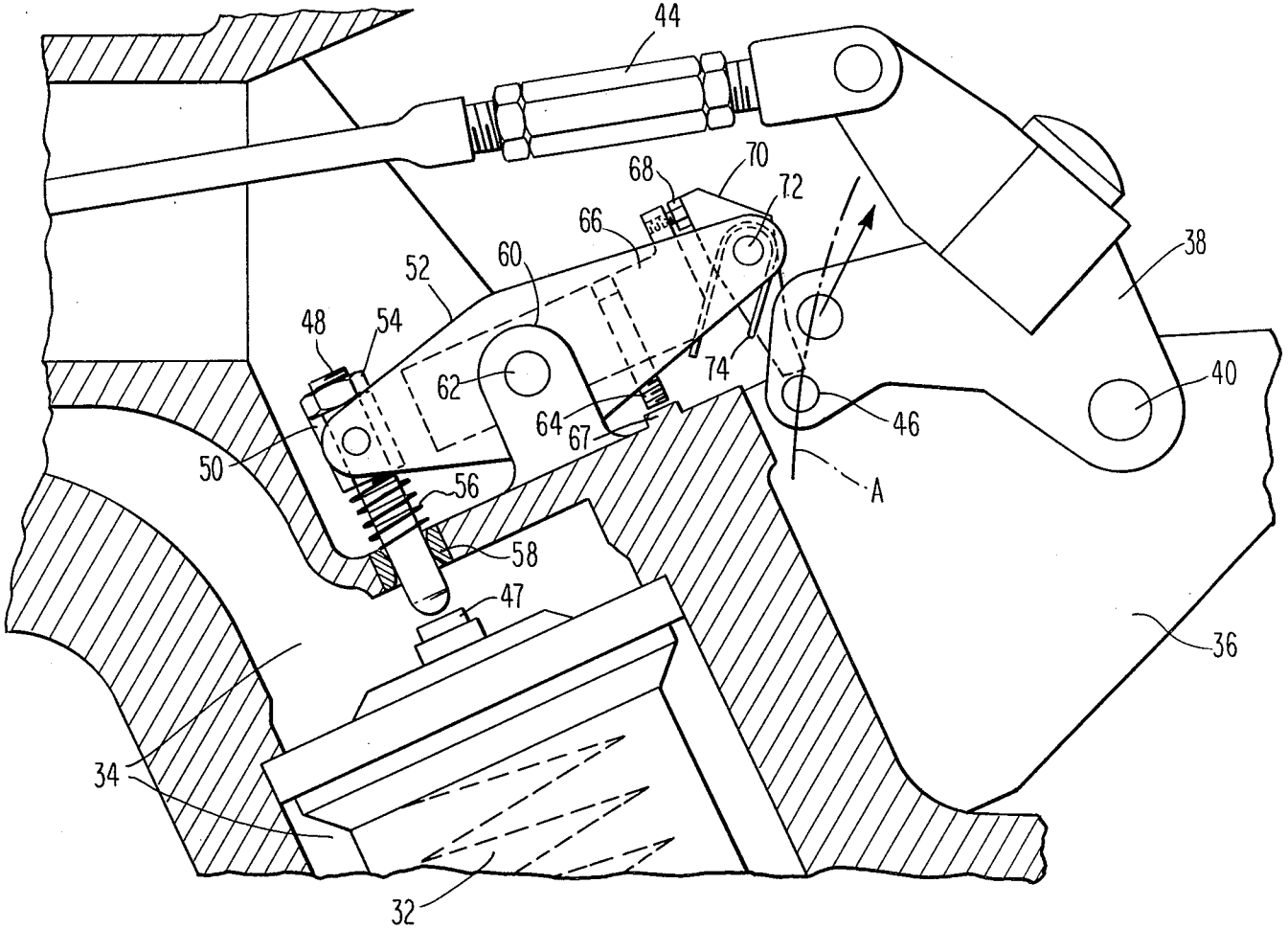
FIGS. 2–5 illustrate linkage within the circuit breaker which embodies the invention.

Turning now to FIG. 2, there is shown apparatus embodying the present invention which constitutes a linkage system of the sort illustrated within the circuit breaker of FIG. 1. In particular, blast valve 32 is shown disposed in a passage 34 which extends below and above the valve. The pressurized gas in the lower portion of the passage, below the valve, is checked by the valve which is shown in its closed mode. The passage 34 is formed in a structure which may be a single casting, herein designated 36, and which pivotally supports a lever 38 upon a pin 40. Another pin (not shown) acts through the center of a hole at some distance from pin 40, along an vector represented by arrow 42. An adjustable pullrod 44 is also pinned to lever 38, and is coupled at its remote end (not shown) to contact member 16 of the circuit interruptor assembly. Finally, lever 38 is provided with a projection, shown here as pin 46. Pin 46 traverses an arc A as lever 38 rotates about pin 40.

The upper surface of the blast valve has an abutment 47 protruding therefrom, which is contacted by the lower end of a pushrod 48. The pushrod is threaded into a trunnion 50 which is pivotally supported in a crank 52. A locknut 54 secures the pushrod in the trunnion. A coil spring 56 is disposed concentrically about pushrod 48, and urges the lower end of trunnion 50 upwardly away from support structure 36. A guide 58, which may be formed of an appropriate bearing material, is press-fitted into the support structure and slidingly receives pushrod 48.

Crank 52 pivots upon pin 62 in support 60. Its clockwise travel is limited by the abutment of an adjustment screw 64, which is threaded into a stop block 66 with a stop 67. Another adjustment screw 68 is threaded into block 66 and abuts a latch 70. The latch in turn is pivotally mounted to crank 52 by means of a pin 72. A spring 74 is provided and urges in a counterclockwise direction.

In the position shown in FIG. 2 the circuit interrupter members 16, 18 are engaged, and the circuit breaker is closed. The pressurized gas in reservoir 28 is restrained by check valve 32, and pushrod 48 is adjusted to maintain a small clearance between its lower end and abutment 47. Screws 64 and 68 are adjusted to maintain a small clearance between the lower end of latch 70 and pin 46.

Figure 3:
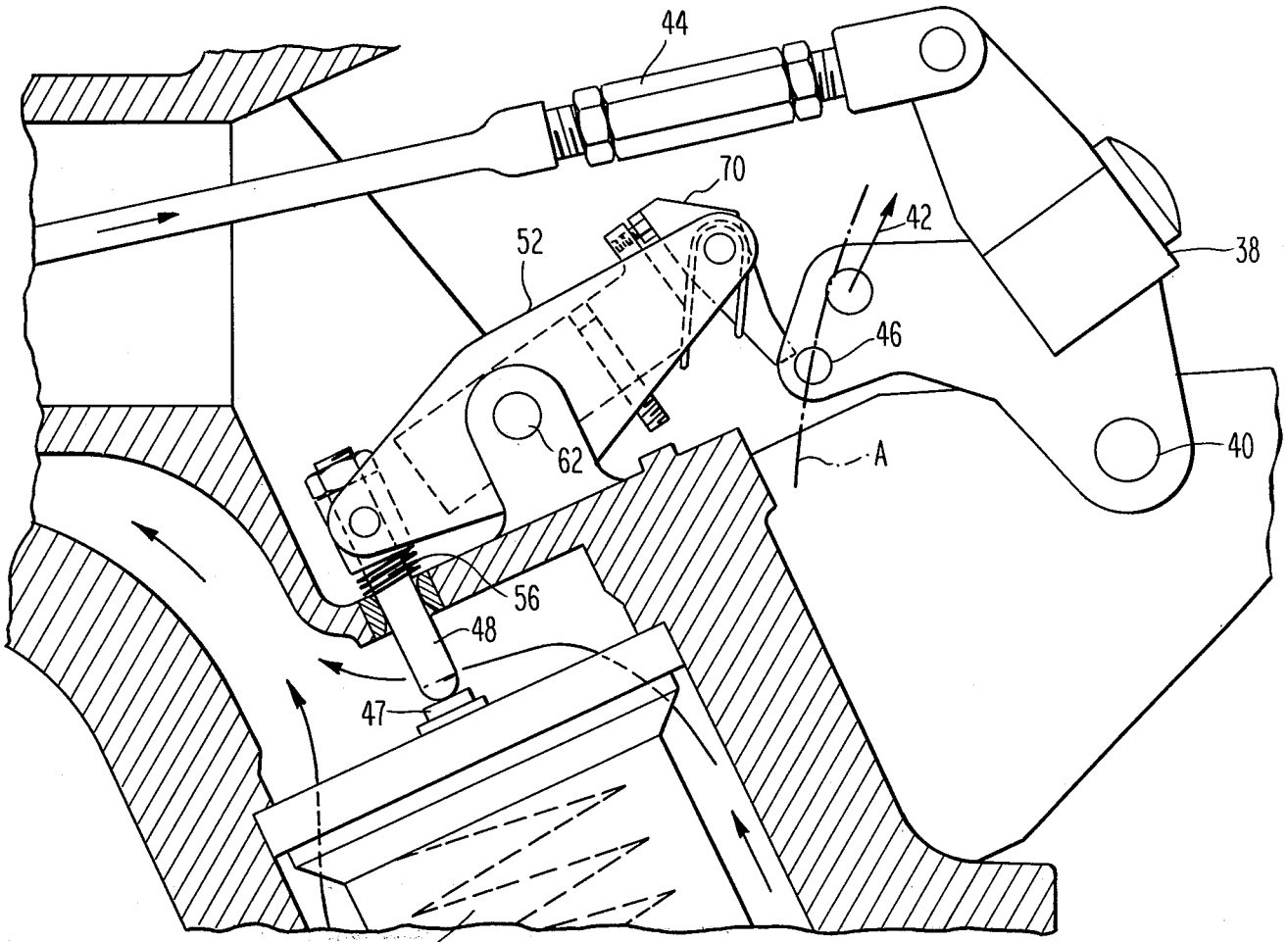

Consider now the case in which the circuit breaker is operated to open a circuit. A tensile force is exerted upon pullrod 26, which acts along vector 42 to displace lever 38 clockwise about pin 40, as shown in FIG. 3. The movement of lever 38 draws pullrod 44 to the right, tending to separate the circuit interrupter elements. After some slight initial travel pin 46 engages the lower end of latch 70 as it moves clockwise along arc A. As the lower end of latch 70 interferes with the path of travel of pin 46, it is urged upwardly. However as the latch, and crank 52, are pivoted about pin 62 the latch describes an arc which diverges from arc A and moves out of engagement with pin 46. In FIG. 3 latch 70 has reached its maximum upward travel and pin 46 is about to continue upwardly, out of engagement with the latch. In the position depicted crank 52 has moved to its extreme counterclockwise position, compressing coil spring 56 and urging pushrod 48 to its lowermost position. The pushrod depresses abutment 47 as shown, opening the blast valve and allowing the arc extinguishing gas to flow through passage 34 to the site of the separation of members 16 and 18.

As will be appreciated by those skilled in the art, blast valve 32 is of the self-timing type, comprising a dashpot assembly whereby pressure from the flow of gas first urges the valve to a full open position, then as pressure imbalances within the valve are relieved through small metering holes a spring urges the valve closed. Accordingly, it is only necessary that the linkage commences the opening operation of the valve, as the duration of gas flow may be controlled by proper valve design.

Figure 4:
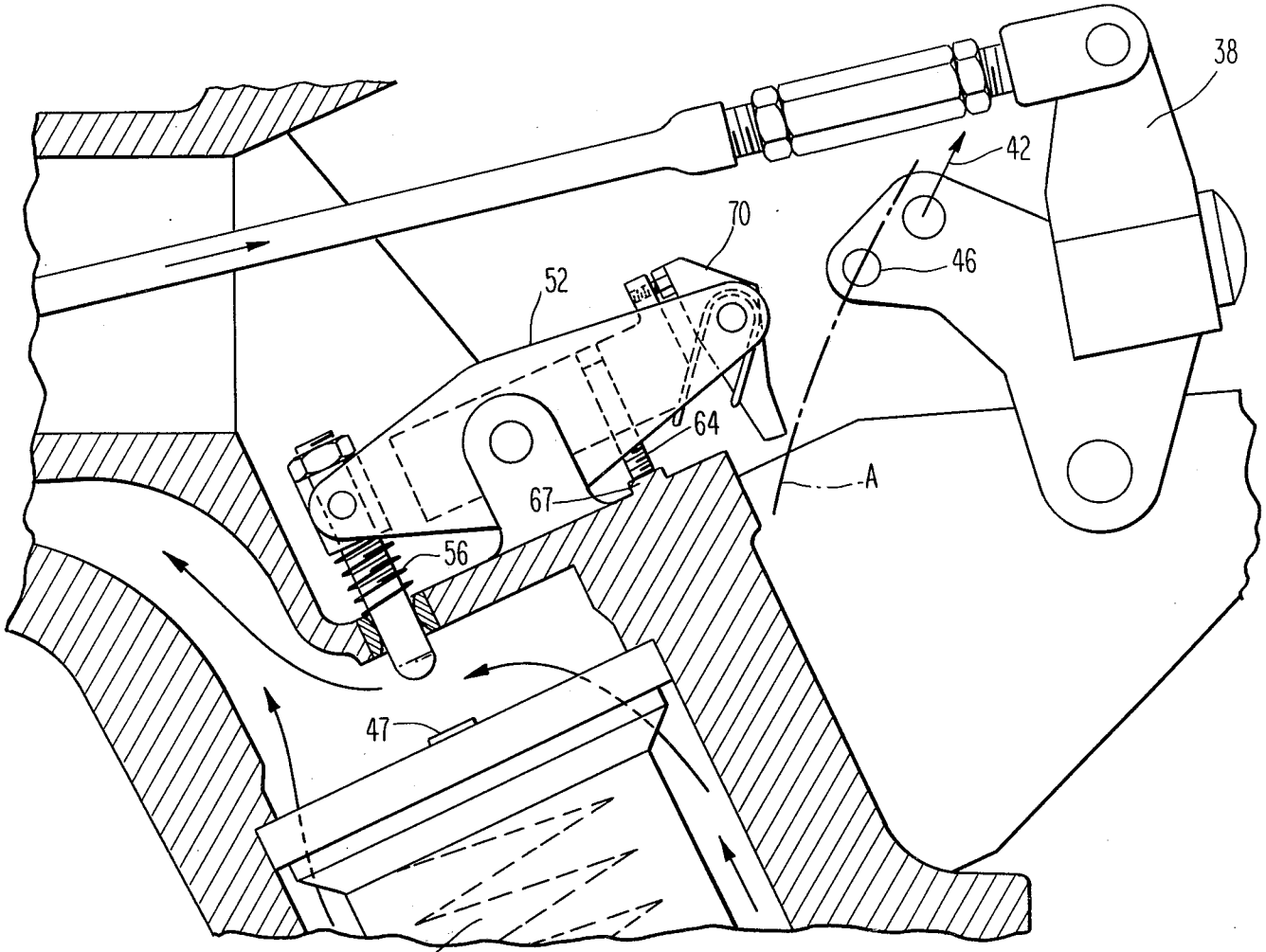

In FIG. 4, abutment 47 has retreated to an even lower position, as the pressure of the flowing gas opens valve 32 to its fullest extent. Pin 46 has continued along arc A as lever 38 is rotated to its extreme clockwise position by a continued tensile force along vector 42. After pin 46 clears the lower end of latch 70, however, coil spring 56 urges crank 52 back in a clockwise direction, so that it snaps back rapidly until adjustment screw 64 encounters stop 67 provided therefor. In this manner crank 52 may be returned to its original, quiescent position before the full travel of the linkage system is completed. The high-pressure gas continues to flow through valve 32 to the site of the drawn-apart interruptor members, to literally extinguish or "blow out" the electric arc therebetween. After some predetermined period of time, dependent upon the size of the metering orifices within valve 32 and the force of the spring therein, the spring therein returns the valve to its closed condition and the flow of arc extinguishing gas is cut off.

Figure 5:
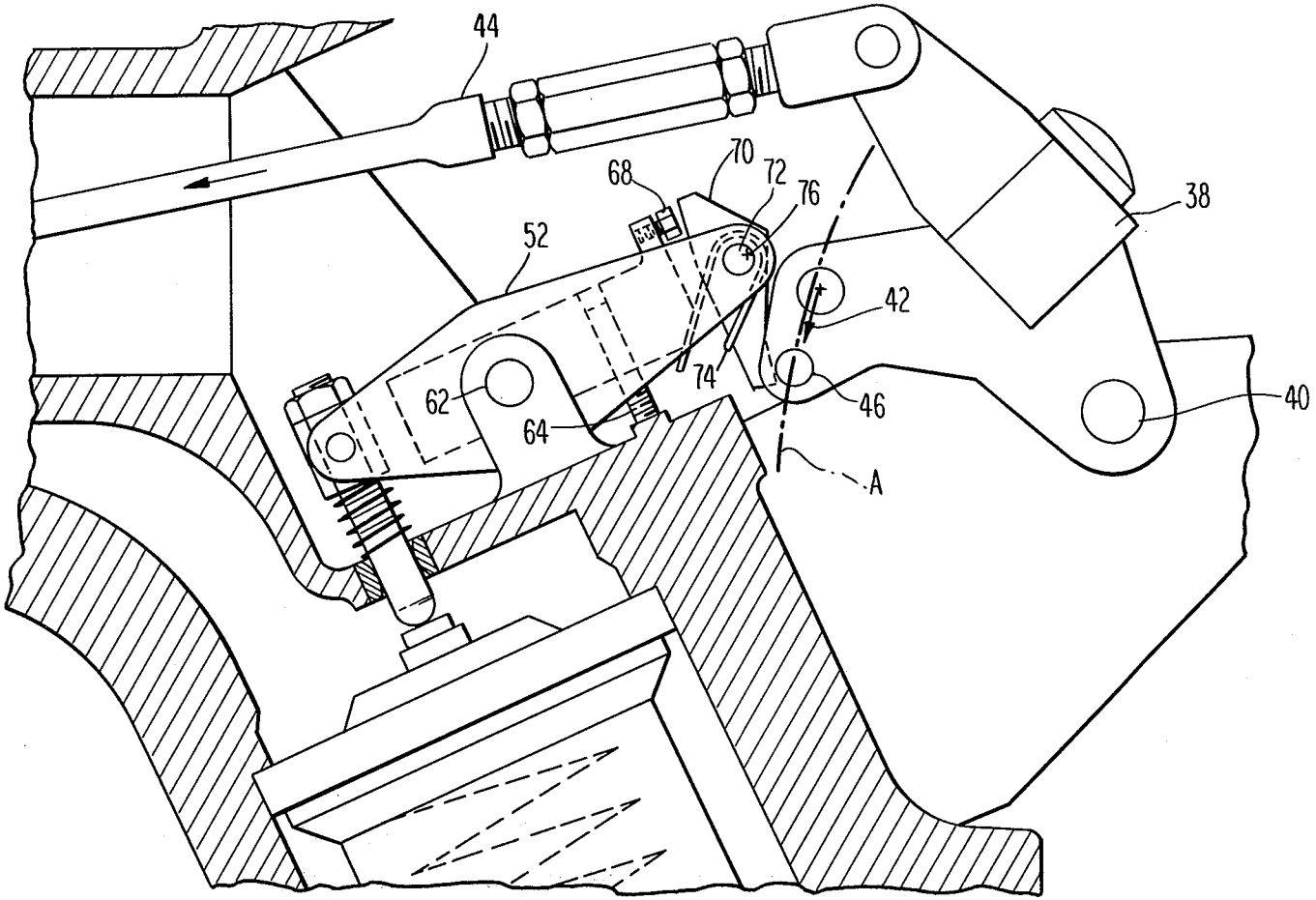

Ultimately pullrod 26 is returned to its original state, in order to close the circuit interrupter contacts. As shown in FIG. 5 the direction of vector 42 reverses, as the rod 26 or its associated linkage urges lever 38 counterclockwise about pivot pin 40. Pushrod 44 moves to cause contact 16 to enter contact 18, thus completing the closing of the circuit interrupter. At the same time, pin 46 describes arc A in a counterclockwise direction, eventually encountering with latch 70 the lower end of which, it will be recalled, lies in interfering relationship with the path of pin 46.

As pin 46 contacts latch 70, it tends to move crank 52 in a clockwise direction. However, since screw 64 is already in engagement with its stop, the crank cannot rotate further. Instead, pressure on the rightward side of latch 70 overcomes the force exerted by spring 74, compressing the latter and causing latch 70 to rotate to the right as shown. The upper end of latch 70 moves away from stop 68 while pin 46 continues toward its quiescent position. When lever 38 reaches its rest position, as shown in FIG. 1, pin 46 passes the lowermost end of latch 70, allowing the latch to snap back in a counterclockwise manner until it abuts setscrew 68. The system is then ready for another operation.

In a preferred embodiment of the present invention, the lowermost end of latch 70, which is engaged by pin 46 during the opening operation, comprises a cylindrical surface generated about a point 76 which lies further from pivot 62 than the does center of pin 72. The net effect of this configuration is to maintain latch 70 in firm contact with stop 68 as pin 46 urges the latch and crank assembly upward. This result obtains since the vector, or line of action, between pin 46 and the cylindrical lower surface of latch 70 extends through a point to the right of pin 72, thus tending to urge latch 70 about pin 76 in a counterclockwise manner.

It will now be recognized that the present invention provides an improved actuating assembly which has the advantages of being rigid and simple, yet without undue mass which would place a strain upon the actuating mechanism. Further, owing to the three simple adjustments made available by the threaded pushrod and pair of set screws, the position and length of travel of the valve-operating member can be closely controlled and easily adjusted to accomodate the flexure of linkage elements during their operation, and also misalignment or cumulative tolerance buildup which may occur in a given circuit breaker.

As will be evident from the foregoing description, certain aspect of the invention are not limited to the particular details of the example illustrated, and it is therefore contemplated that other modifications or applications will occur to those skilled in the art. It is accordingly intended that the appended claims shall cover all such modifications and applications as do not depart from the true spirit and scope of the invention.

What is claimed as new the desired to be secured by Letters Patent of the United States is:

1. In a power circuit breaker of two-pressure type including circuit interrupter means, a tank enclosing said means and confining therein a gas at a first, lower pressure, a reservoir confining the gas at a second, higher pressure, and a gas passage extending from said reservoir to the interruptor means, the improvement comprising:

valves means disposed in the gas conduit;

linkage means coupled to the interrupter means and operable to open and close the interrupter means;

a lever coupled to said linkage means and mounted for rotating in an arc in a first direction in response to movement of said linkage to open the interrupter and rotating in said arc in a second direction in response to movement of said linkage to close said interrupter, said lever having a projection thereon;

a crank having a first and a second end and being pivotally mounted intermediate said ends at a point between said valve means and said arc;

a pushrod pivotally attached to the first end of said crank;

guide means for confining said pushrod to a path whereby the pushrod will intercept said valve means as said crank pivots about its pivotal mounting;

a latch pivotally mounted upon the second end of said crank, said latch having an end extending into a portion of the arc traversed by said projection of said lever;

spring means carried by said crank biasing said latch for rotation in a first direction toward said lever;

second spring means biasing said crank to rotate in a direction to cause said latch to approach said arc; and a stop mounted on said crank and confronting said latch for limiting rotation of said latch caused by said spring means;

whereby rotation of said lever in said arc in a first direction urges said projection against said latch, said latch moving free of said arc after said crank has rotated by a predetermined amount, and after encountering said valve means; said projection interfering with said latch when said lever rotates in said second direction to cause said latch to be deflected against the pressure of said spring means, said projection and said lever being thereby allowed to return to their quiescent state.

2. The invention defined in claim 1, further including threaded means engaging said stop and confronting said latch for adjusting the quiescent resting point of said latch.

3. The invention defined in claim 2, wherein said pushrod comprises a first threaded member pivotally coupled to said crank, and a second threaded member engaging said first member.

4. The invention defined in claim 3, wherein said guide means comprises an opening in the power circuit breaker support carrying said crank pivot, and said pushrod extends therethrough.

5. The invention defined in claim 4, wherein said second spring means is a coil spring disposed concentrically about said pushrod, and between said guide means and said first threaded portion of said pushrod.

6. The invention defined in claim 1, wherein said extending end of said latch is provided with a generally cylindrical surface, said surface being generated about a point which is further from the crank pivot point than is said latch pivot point.

* * * * *